US005645372A

United States Patent [19]

Hahn

[11] Patent Number: 5,645,372

[45] Date of Patent: Jul. 8, 1997

[54] FORM FOR CONSTRUCTION OF A CATCH BASIN

[76] Inventor: Raymond F. Hahn, 11 First St., Mine Hill, N.J. 07801

[21] Appl. No.: 564,646

[22] Filed: Nov. 29, 1995

[51] Int. Cl.[6] ..... E02D 29/12

[52] U.S. Cl. ..... 405/52; 52/20; 52/21; 249/10; 249/155; 404/5; 405/36; 405/303

[58] Field of Search ..... 405/36, 52, 124–127; 52/20; 249/10, 13, 209, 155; 404/4, 5, 25, 26

[56] References Cited

U.S. PATENT DOCUMENTS

| | | | |
|---|---|---|---|
| 884,072 | 4/1908 | Carey | 405/125 |
| 997,383 | 7/1911 | Foster | 405/124 |
| 1,098,766 | 7/1914 | Scully et al. | 405/125 |
| 1,453,136 | 4/1923 | Hitchcock | 405/125 |
| 2,650,411 | 9/1953 | Mitchell | 249/10 |
| 3,385,012 | 5/1968 | Lovegreen | 52/21 |
| 3,436,051 | 4/1969 | Nakahara | 249/1 |
| 3,695,153 | 10/1972 | Dorris | 52/21 X |
| 4,192,625 | 3/1980 | Peletz | 404/5 |
| 4,723,871 | 2/1988 | Roscoe | 405/124 X |
| 4,844,403 | 7/1989 | Castle | 249/10 |
| 4,957,268 | 9/1990 | Picollo et al. | 249/10 |

*Primary Examiner*—Dennis L. Taylor

[57] ABSTRACT

A form for construction of a catch basin including a water insert form that has a front insert wall, a rear insert wall, a pair of side insert walls and a concave bottom edge. The front insert wall and the rear insert wall each have knockouts along the bottom. The mortar insert form is positioned over an inlet pipe and an outlet pipe of a catch basin for bridges. Also, included are a pair of thumb screws that are capable of being positioned through one of the side walls of the mortar insert form. Included is a height mortar bridge form that has a front bridge wall, a rear bridge wall, and a pair of side bridge walls. The front bridge wall and the rear bridge wall each have a concave bottom. The front bridge wall and the rear bridge wall each have an inner wall that sloops downwardly from a top edge to form a cross rib. Lastly, the height mortar bridge form is locked within the mortar insert form a pair of thumb screws. This provides a form for mortar to be poured into.

9 Claims, 2 Drawing Sheets

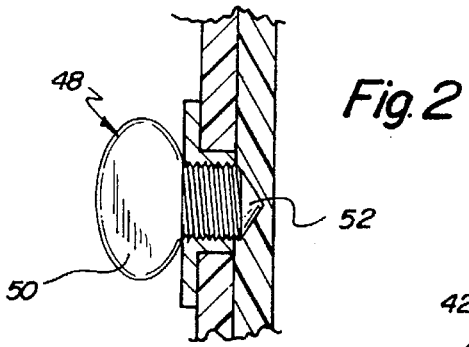
Fig. 2
Fig. 1
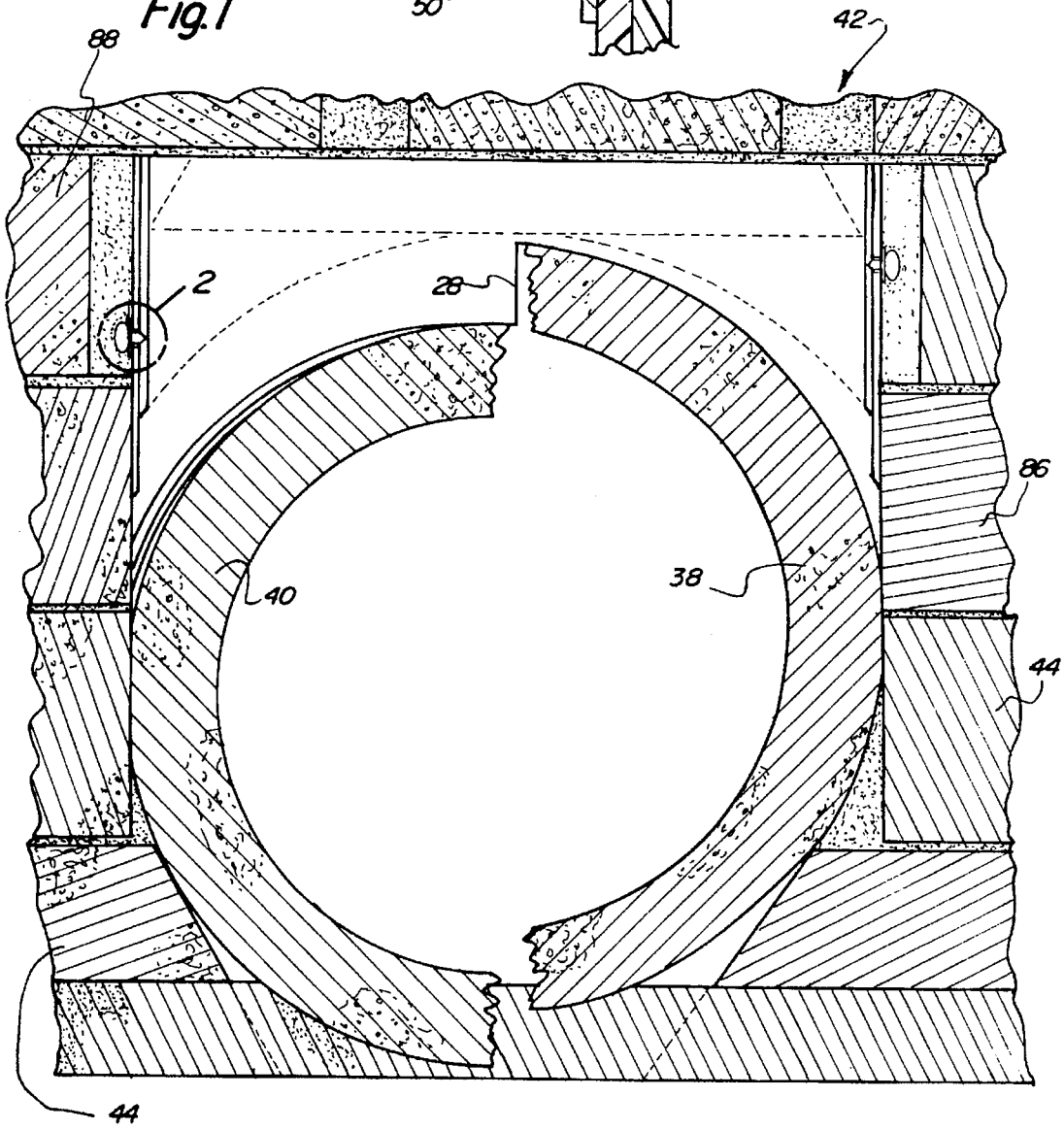

FORM FOR CONSTRUCTION OF A CATCH BASIN

BACKGROUND OF THE INVENTION

1. Field of the Invention

The present invention relates to a form for construction of a catch basin and more particularly pertains to providing a pair of plastic forms wherein an insert form is used to bridge the inlet and outlet pipes and an adjustable height form is positioned within the insert form giving height to the insert form, and further allowing mortar to be poured into the form bridging the inlet and outlet pipes of a catch basin.

2. Description of the Prior Art

The use of catch basin is known in the prior art. More specifically, catch basin heretofore devised and utilized for the purpose of filtering water runoff are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,957,268 to Picollo and Guillemette discloses a disposable curb inlet drain form. U.S. Pat. No. 4,844,403 to Castle discloses a reusable form for storm sewer collection box inlet. U.S. Pat. No. Des. 276,839 to McCoy discloses a catch basin. U.S. Pat. No. 4,261,823 to Gallagher and Bastian discloses a storm drain catch basin. U.S. Pat. No. 4,192,625 to Pelletc discloses a precast concrete catch basin inlet. Lastly, U.S. Pat. No 3,436,051 to Nakahara discloses a form for concrete structures and particularly concrete catch basin units.

While these devices fulfill their respective, particular objectives and requirements, the aforementioned patents do not describe form for construction of a catch basin that allows a plastic adjustable height form that bridges the inlet and outlet pipes of a catch basin to be filled with mortar, to allow the remaining courses of blocks to be laid without delay while the mortar cures and hardens in the form.

In this respect, the form for construction of a catch basin according to the present invention substantially departs from the conventional concepts and designs of the prior art, and in doing so provides an apparatus primarily developed for the purpose of providing a pair of plastic forms wherein an insert form is used to bridge the inlet and outlet pipes and an adjustable height form is positioned within the insert form giving height to the insert form, and further allowing mortar to be poured into the form bridging the inlet and outlet pipes of a catch basin.

Therefore, it can be appreciated that there exists a continuing need for a new and improved form for construction of a catch basin which can be used for providing a pair of plastic forms wherein an insert form is used to bridge the inlet and outlet pipes and an adjustable height form is positioned within the insert form giving height to the insert form, and further allowing mortar to be poured into the form bridging the inlet and outlet pipes of a catch basin. In this regard, the present invention substantially fulfills this need.

SUMMARY OF THE INVENTION

In view of the foregoing disadvantages inherent in the known types of catch basin now present in the prior art, the present invention provides an improved form for construction of a catch basin. As such, the general purpose of the present invention, which will be described subsequently in greater detail, is to provide a new and improved form for construction of a catch basin and method which has all the advantages of the prior art and none of the disadvantages.

To attain this, the present invention essentially comprises a generally rectangular adjustable mortar insert form. The adjustable mortar insert form has a front insert wall, a rear insert wall, and a pair of side insert walls. Each wall has a flat top edge. The front and rear insert walls each have a concave bottom edge with a ridge centrally positioned. The front insert wall has front knockouts along the bottom edge and adjacent one of the side walls. The rear insert wall has rear knockouts along the bottom edge and adjacent the side wall adjacent the front knockouts. The adjustable mortar insert form is positioned over an inlet pipe and an outlet pipe of a catch basin for bridging. The adjustable mortar insert form is positioned over the inlet pipe and the outlet pipe at a first course of blocks have been placed around the outlet pipe and the inlet pipe. The front knockouts and the rear knockouts may be broken away one from the other for aligning the mortar insert form with the first course of blocks when the outlet pipe and the inlet pipe are unaligned. Also, a pair of self tapping thumb screws are included. The thumb screws have a screw head and a screw tip. One of each thumb screw is positioned through one of the side walls of the adjustable mortar insert form. Included is a generally rectangular adjustable height mortar bridge form. The height mortar bridge form has a front bridge wall, a rear bridge wall, and a pair of side bridge walls. Each wall has a top edge with a top edge of the front bridge wall and the rear bridge wall having a width greater than the top of each side wall. The front bridge wall and the rear bridge wall each have a concave bottom edge. The front bridge wall has a front inner wall that sloops downwardly from a top edge to form a front cross rib. The rear bridge wall has a rear inner wall that sloops downwardly from the top edge to form a rear cross rib. The adjustable height mortar bridge form is positioned within the adjustable mortar insert form. The adjustable height mortar bridge form is capable of sliding up and down within the adjustable mortar insert form to increase the height of the insert form. The height of the insert form is increased, as needed, for accommodating a second and third course of blocks. The adjustable height mortar bridge is locked within the adjustable mortar insert form, when the desired height is obtained, by one of the thumb screws. Lastly, the adjustable height mortar bridge is locked in positioned and capable of receiving a quantity of mortar for forming a mortar sheet. The adjustable height mortar insert form can support the mortar curing therein while the second and third course of blocks are placed in positioned.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved form for construction of a catch basin which has all of the advantages of the prior art catch basin and none of the disadvantages.

It is another object of the present invention to provide a new and improved form for construction of a catch basin which may be easily and efficiently manufactured and marketed.

It is further object of the present invention to provide a new and improved form for construction of a catch basin which is of durable and reliable constructions.

An even further object of the present invention is to provide a new and improved form for construction of a catch basin which is susceptible of a low cost of manufacture with regard to both materials and labor, and which accordingly is then susceptible of low prices of sale to the consuming public, thereby making such form for construction of a catch basin economically available to the buying public.

Still yet another object of the present invention is to provide a new and improved form for construction of a catch basin which provides in the apparatuses and methods of the prior art some of the advantages thereof, while simultaneously overcoming some of the disadvantages normally associated therewith.

Even still another object of the present invention is to provide a form for construction of a catch basin for providing a pair of plastic forms wherein an insert form is used to bridge the inlet and outlet pipes and an adjustable height form is positioned within the insert form giving height to the insert form, and further allowing mortar to be poured into the form bridging the inlet and outlet pipes of a catch basin.

Lastly, it is an object of the present invention to provide a new and improved form for construction of a catch basin including a water insert form that has a front insert wall, a rear insert wall, and a pair of side insert walls. The front and rear insert walls each have a concave bottom edge. The front insert wall and the rear insert wall each have knockouts along the bottom and adjacent one of the side walls. The mortar insert form is positioned over an inlet pipe and an outlet pipe of a catch basin for bridges. Also, included are a pair of thumb screws that are capable of being positioned through one of the side walls of the mortar insert form. Included is a height water bridge form that has a front bridge wall, a rear bridge wall, and a pair of side bridge walls. The front bridge wall and the rear bridge wall each have a concave bottom. The front bridge wall and the rear bridge wall each have an inner wall that sloops downwardly from a top edge to form a cross rib. Lastly, the height mortar bridge form is positioned within the mortar insert form and locked by a pair of thumb screws. When the mortar bridge form and the mortar insert form are locked together, mortar may be poured into them.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the form for construction of a catch basin constructed in accordance with the principles of the present invention.

FIG. 2 is an enlarged cross sectional view of the thumb screw as shown at position 2 of FIG. 1.

The same reference numerals refer to the same parts through the various Figures.

DESCRIPTION OF THE PREFERRED EMBODIMENT

Figure 3:
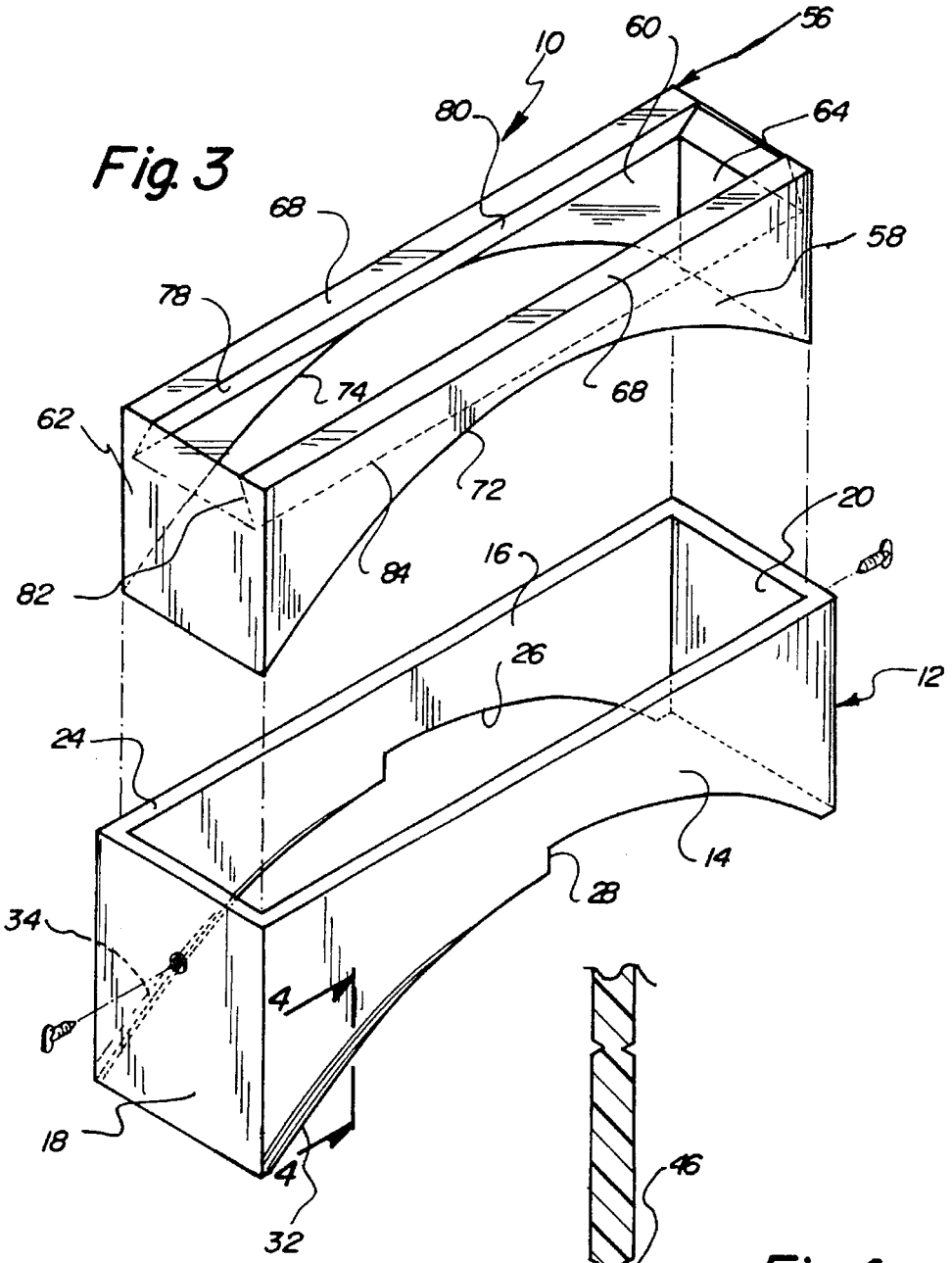
FIG. 3 is an exploded view of the operable components of the present invention.

With reference now to the drawings, and in particular to FIG. 3 thereof, the preferred embodiment of the new and improved form for construction of a catch basin embodying the principles and concepts of the present invention and generally designated by the reference numeral 10 will be described.

The present invention, the form for construction of a catch basin 10 is comprised of a plurality of components. Such components in their broadest context include a mortar insert form, height mortar bridge, and thumb screws. Such components are individually configured and correlated with respect to each other so as to attain the desired objective.

Specifically, the present invention includes a generally rectangular adjustable mortar insert form 12, as shown in FIG. 3. The adjustable mortar insert form has a front insert wall 14, a rear insert wall 16, and a pair of side insert walls 18 and 20. Each wall has a flat top edge 24. The mortar insert is formed of a rigid plastic, preferably polyvinylchloride. The front and rear insert walls, each have a concave bottom edge 26 with a ridge 28 centrally positioned thereon. The front insert wall has front knockouts 32 along the bottom edge 28. The front knockouts are adjacent one of the side walls. The rear insert wall has rear knockouts 34 along the bottom edge 26. The rear knockouts are adjacent the side wall that is adjacent the front knockouts.

As best illustrated in FIG. 1, the ridge 28, allows the adjustable mortar insert form to be positioned over an inlet pipe 38 and an outlet pipe 40 of a catch basin 42. The adjustable mortar insert form bridges the inlet pipe and the outlet pipe. The adjustable mortar insert form is positioned over the inlet pipe and the outlet pipe when a first course of blocks 44 have been placed around the outlet pipe and the inlet pipe. The front knockouts and the rear knockouts may be broken away one from the other for aligning the mortar insert form when the first course of blocks are place completely around the pipes. When the adjustable mortar insert form is placed over the inlet pipe and the outlet pipe the front knockouts and the rear knockouts are broken away one from the other for alignment of the mortar insert form. The adjustable mortar insert form must be aligned with the first course of blocks, especially when the outlet pipe and the inlet pipe are unaligned.

Figure 4:
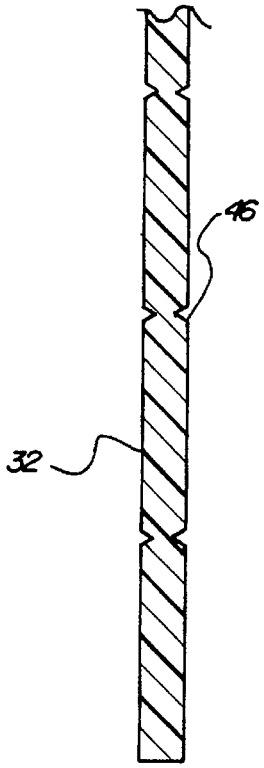
FIG. 4 is a cross sectional view of the present invention taken along line 4—4 of FIG. 3.

As illustrated in FIG. 4, the front knockouts 32 have grooves 46 that are about one-eight of an inch deep. These grooves allow the knockout to be broken off with a pair of pliers in increments. Breaking the knockouts with the pliers at these grooves ensures that the adjustable mortar insert form fits around the outlet pipe.

Also, a pair of self tapping thumb screws 48 are included. The thumb screws have a screw head 50 and a screw tip 52. One of each thumb screw is capable of being positioned through one of the side walls of the adjustable mortar form 12.

Included is a generally rectangular adjustable height mortar bridge form 56. As shown in FIG. 3, the height mortar bridge form has a front bridge wall 58, a rear bridge wall 60, and a pair of side bridge walls 62 and 64. The adjustable height mortar bridge form is formed of the same rigid plastic used to form the mortar insert. Each wall has a top edge 68. The top edge of the front bridge wall and the rear bridge wall have a width greater than the top edge of each side wall. The front bridge wall and the rear bridge wall each have a concave bottom edge 72 and 74. The front bridge wall has a front inner wall 78. The front inner wall sloops downwardly from the top edge to form a front cross rib 80. The rear bridge wall has a rear inner wall 82. The rear inner wall sloops downwardly from the top edge to form a rear cross rib 84. The cross ribs of the front inner wall and the rear inner wall gives the form strength. The height mortar bridge form has to be strong enough to supper the form when the second course of blocks 86 and third course of blocks 88 are being positioned around the pipes and adjacent the adjustable mortar insert form.

Furthermore, the adjustable height mortar bridge form 56 is positioned within the adjustable mortar insert form 12. The adjustable height mortar bridge form may be slide up and down within the adjustable mortar insert form to increase the height of the walls of the insert form. The height of the walls are increased, as needed, for accommodating the second and third course of blocks. The adjustable height mortar bridge form is locked within the adjustable mortar insert form, when the desired height is obtained, by the pair of thumb screws 48.

Lastly, the adjustable height mortar bridge form, when locked in positioned, may receive a quantity of mortar therein. The mortar passes from the adjustable height mortar bridge form into the adjustable mortar insert form to form a block mortar sheet. The two forms, when locked together, will support the mortar curing while the second and third course of blocks are being positioned therearound.

The present invention provides the use of plastic forms in the construction of a forty-two inch by forty-eight inch catch basin. The present invention of the outlet pipes controls the depth of the first course of blocks. The first course of blocks start at the level of the bottom of the outlet pipe. This allows for a mortar flow of about two and one-fourth inch thickness after the walls of blocks have been completed. The first course of blocks are laid to form the inside dimensions of the catch basin for the grating to fit at the completion. In fitting the block of the first course, the block contacting the inlet and outlet pipes must be cut on an angle against the pipe. Any existing voids must be filled with the mortar. The second and third course of blocks can then be laid staggering the joints, as shown in FIG. 1. At this time, the adjustable mortar insert form is positioned over the inlet and outlet pipes to form a bridge that can be filled with mortar. In some instances, this mortar insert form is not tall enough to ensure an even surface once the second and third course of blocks are placed thereon. To provide additional length an adjustable height mortar bridge form is included with the present invention.

This mortar bridge form is capable of being placed within the mortar insert form to be locked therein. Once in, the desired height is determined, the two forms are locked and the mortar is poured into the forms for curing. After the mortar is poured, the remaining course of blocks are laid and abut within three and one-half inch or less of the lowest level of the existing road surface. The second and third course of blocks may be laid while the mortar is curing within the two forms. The two forms are made of a rigid plastic and are structured for strength to hold the mortar as it cures while the second and third course of blocks are being placed therearound.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved form for construction of a catch basin for receipt of surface water runoff comprising in combination:

a generally rectangular adjustable mortar insert form having a front insert wall, a rear insert wall and a pair of side insert walls, each wall having a flat top edge, the front and rear insert walls each having a concave bottom edge with a ridge centrally positioned thereon, the front insert wall having front knockouts along the bottom edge and adjacent one of the side walls, the rear insert wall having rear knockouts along the bottom edge and adjacent the side wall adjacent the front knockouts;

the adjustable mortar insert form being capable of being positioned over an inlet pipe and an outlet pipe of a catch basin for bridging thereof, the adjustable mortar insert form being positionable over the inlet pipe and the outlet pipe when a first course of blocks being completed around the outlet pipe and the inlet pipe, the front knockouts and the rear knockouts capable of having one of each being broken away from another knockout, one of each knockouts being broken off for aligning the mortar insert form with the first course of blocks, when the outlet pipe and the inlet pipe being unaligned;

a pair of self taping thumb screws having a screw head and a screw tip, one of each thumb screw being capable of being positioned through one of the side walls of the adjustable mortar insert form;

a generally rectangular adjustable height mortar bridge form having a front bridge wall, a rear bridge wall and a pair of side bridge walls, each wall having a top edge with the top edge of the front bridge wall and the rear bridge wall having a greater width than the top edge of each side wall, the front bridge wall and the rear bridge wall each having a concave bottom edge, the front bridge wall having a front inner wall sloping downwardly from the top edge thereof to form a front crossrib, the rear bridge wall having a rear inner wall sloping downwardly from the top edge thereof to form a rear crossrib;

the adjustable height mortar bridge form capable of being positioned within the adjustable mortar insert form, the adjustable height mortar bridge form capable of sliding upwardly and downwardly within the adjustable mortar insert form increasing a height of the insert form, as needed, for accommodation of a second and third course of blocks, the adjustable height mortar bridge being locked within the adjustable mortar insert form, when the desired height being obtained, by one of the thumb screws; and the adjustable height mortar bridge being locked in position being capable of receiving a quantity of mortar therein for forming a block mortar sheet, the adjustable height mortar being capable of supporting the mortar curing therein while the second and third course of blocks being positioned therearound.

2. A form for construction of a catch basin comprising:

a mortar insert form having a front insert wall, a rear insert wall and a pair of side insert walls, the front and rear insert wall each having a concave bottom edge, the front insert wall and the rear insert wall each having knockouts along the bottom edge and adjacent one of the side walls, the mortar insert form being capable of being positioned over an inlet pipe and an outlet pipe of a catch basin for bridging thereof;

a pair of thumb screws with one of each capable of being positioned through one of the side walls of the mortar insert form;

a height mortar bridge form having a front bridge wall, a rear bridge wall and a pair of side bridge walls, the front bridge wall and the rear bridge wall each having a concave bottom edge, the front bridge wall and the rear bridge wall each having an inner wall sloping downwardly from a top edge to form a crossrib; and the height mortar bridge form capable of being positioned within the mortar insert form and locked therein with the pair of thumb screws, and capable of receiving therein a quantity of mortar.

3. The form for construction of a catch basin as set forth in claim 2 the mortar insert form being adjustable with the front and rear knockouts whereby the front knockouts and the rear knockouts capable of being broken away from one of the other knockout for aligning the mortar insert form with the first course of block, when the outlet pipe and the inlet pipe being unaligned.

4. The form for construction of a catch basin as set forth in claim 3 wherein each wall having a flat top edge and the concave bottom edge having a ridge centrally positioned thereon, and the adjustable mortar insert form being positionable over the inlet pipe and the outlet pipe when a first course of block being completed around the outlet pipe and the inlet pipe.

5. The form for construction of a catch basin as set forth in claim 2 wherein the thumb screw being a self taping and having a screw head and a screw tip.

6. The form for construction of a catch basin as set forth in claim 2 wherein each wall of the mortar bridge form having a top edge, and the top edge of the front bridge wall and the rear bridge wall having a greater width than the top of each side wall.

7. The form for construction of a catch basin as set forth in claim 3 wherein the height mortar bridge form being adjustable and capable of sliding upwardly and downwardly within the adjustable mortar insert form, and increasing a height of the mortar insert form, as needed, for accommodation of a second and third course of blocks.

8. The form for construction of a catch basin as set forth in claim 7 wherein the adjustable height mortar bridge being capable of having a block mortar sheet formed therein, when the desired height being obtained by locking the mortar bridge form within the mortar insert form.

9. The form for construction of a catch basin as set forth in claim 8 wherein the adjustable height mortar being capable of support the mortar curing therein while the second and third course of blocks being positioned therearound.

* * * * *